US008689477B2

(12) United States Patent
Gomez et al.

(10) Patent No.: US 8,689,477 B2
(45) Date of Patent: Apr. 8, 2014

(54) TOP OPENING, MODULAR TOP RAIL, MULTI-RIFLE ADAPTABLE FREE FLOAT RAIL ADAPTOR SYSTEM (ARM-R)

(75) Inventors: Jesus S. Gomez, Cambridge, MD (US); Darren Mellors, Fredericksburg, VA (US)

(73) Assignee: LWRC International LLC, Cambridge, MD (US)

( * ) Notice: Subject to any disclaimer, the term of this patent is extended or adjusted under 35 U.S.C. 154(b) by 0 days.

(21) Appl. No.: 13/430,281

(22) Filed: Mar. 26, 2012

(65) Prior Publication Data

US 2013/0055613 A1 Mar. 7, 2013

Related U.S. Application Data

(62) Division of application No. 12/217,874, filed on Jul. 9, 2008, now Pat. No. 8,141,289.

(51) Int. Cl.
*F41C 23/16* (2006.01)

(52) U.S. Cl.
USPC ..... 42/72

(58) Field of Classification Search
USPC ..... 42/90, 72, 124, 71.01, 85, 75.01, 96, 42/75.02, 143, 115; 89/1.42
See application file for complete search history.

(56) References Cited

U.S. PATENT DOCUMENTS

| | | | | |
|---|---|---|---|---|
| 4,663,875 | A * | 5/1987 | Tatro | 42/71.01 |
| 5,198,600 | A | 3/1993 | E'Nama | |
| 5,343,650 | A | 9/1994 | Swan | |
| 5,826,363 | A | 10/1998 | Olson | |
| 6,134,823 | A | 10/2000 | Griffin | |
| 6,792,711 | B2 | 9/2004 | Battaglia | |
| 6,945,154 | B1 * | 9/2005 | Luth | 89/14.1 |
| 7,216,451 | B1 * | 5/2007 | Troy | 42/72 |
| 7,707,762 | B1 * | 5/2010 | Swan | 42/85 |
| 7,716,865 | B2 * | 5/2010 | Daniel et al. | 42/75.02 |
| 8,141,289 | B2 * | 3/2012 | Gomez et al. | 42/90 |
| 2004/0049964 | A1 * | 3/2004 | Vais | 42/75.02 |
| 2007/0033851 | A1 * | 2/2007 | Hochstrate et al. | 42/75.01 |
| 2008/0092422 | A1 * | 4/2008 | Daniel et al. | 42/90 |

OTHER PUBLICATIONS

In the U.S. Patent and Trademark Office, Notice of Allowance in re: U.S. Appl. No. 12/217,874, dated Oct. 12, 2011, 6 pages.
In the U.S. Patent and Trademark Office, Office Action in re: U.S. Appl. No. 12/217,874, dated Jan. 4, 2011, 7 pages.
In the U.S. Patent and Trademark Office, Requirement for Restriction/Election in re: U.S. Appl. No. 12/217,874, dated Oct. 12, 2011, 6 pages.
In the U.S. Patent and Trademark Office, Notice of Allowance in re: U.S. Appl. No. 12/217,874, dated Nov. 15, 2011, 5 pages.

* cited by examiner

*Primary Examiner* — Michael Carone
*Assistant Examiner* — Reginald Tillman, Jr.
(74) *Attorney, Agent, or Firm* — Patton Boggs LLP; F. Wayne Thompson, Jr.

(57) ABSTRACT

An improved Rail Adaptor System/Rail Accessory System (RAS) which attaches to a firearm. The rail is top opening, modular, and free floats the barrel. Provided is a rigid, lightweight, strong platform for mounting firearm accessories. Heat transmission from the barrel assembly to the user is limited. The user is also protected from ventilated gases originating from the operating system. A quick detachable top rail section is provided so that the gas system may be easily accessed. This removable top section of the rail is what makes this device unique because the RAS may be installed without removing the barrel, gas system, front sight base, flash hider or the barrel nut. The herein described RAS is adaptable to a wide variety of firearms with the use of conversion parts. The top tail "returns to zero" on reinstallation allowing the remounting of various optics and electronic gun sites without the need to realign them.

6 Claims, 7 Drawing Sheets

45

TOP OPENING, MODULAR TOP RAIL, MULTI-RIFLE ADAPTABLE FREE FLOAT RAIL ADAPTOR SYSTEM (ARM-R)

This is a divisional application of U.S. application Ser. No. 12/217,874, filed Jul. 9, 2008, which issues as U.S. Pat. No. 8,141,289 on Mar. 27, 2012, the priority of which is hereby claimed.

BACKGROUND OF THE INVENTION

1. Field of Invention

This invention relates to the field of firearms, specifically accessories and mounting devices for firearms.

2. Prior Art

Several years ago the military started the SCAR program to select a weapon which would replace all rifles currently utilizing a direct impingement operating system in use by the military. In short, a replacement of the M16/M4 rifle was being sought.

To explain the difference in the two systems, both direct gas impingement rifles and piston driven rifles have a hole toward the front end of the barrel. As the cartridge is fired, burning propellant causes the bullet to move down the bore of the rifle. The propellant burns, generating expanding gases thereby increasing the pressure behind the bullet. As the bullet passes the hole in the barrel, some of the gas is tapped off. This is where the direct gas impingement and piston driven rifles become different.

In a direct impingement rifle the gas is directed by means of a long tube back into the receiver of the rifle. There is a cupped bolt carrier key which the tube fits into. The force of the gas pushes back the bolt carrier and reciprocates the rifle's self loading action. The disadvantage of this is dirty gases and carbon residues are deposited into the rifle's action and with sustained fire can lead to eventual failure as the close tolerance parts are caked with carbon. The long trip the gas must make before imparting its force also allows much of the gas to leak out of the system if parts are not mated exactly.

Rifles and carbines utilizing a gas piston system offer the user a more reliable, robust, controllable, cleaner operating system. As the gas is tapped off the barrel, it is immediately met by a gas piston. The gas drives the piston back which pushes a rod that actuates the action of the rifle. The gas piston uses all of the tapped gas to generate the rear momentum of the piston. Once it has moved back far enough with enough momentum to actuate the mechanism of the rifle, all excess gases are rapidly vented off. The rapid venting of all excess gases makes for an efficient and clean, self regulating system since about 5% of the volume of gas is actually used to operate the firearm. None of the hot, dirty gas or carbon enters the moving parts located in the receiver of the host firearm.

In recent years there has been industry-wide interest to incorporate a gas piston system into the M16/M4 type rifle and its variants. The push for this substantial change is due to the shortcomings which the direct gas impingement M16/M4 type rifle has shown in sandy environments and after prolonged use.

Traditionally the M16/M4 type rifle utilized a gas tube, well known in the prior art, which has a curve along its length thus allowing for the current generation of rail adaptor systems (RAS's) system and hand guards to function. Gas piston systems have to be relatively straight along the entire length of the piston utilized. This straight piston and related components necessitated the development of new methods for the attachment of a RAS.

The advantages of a gas piston system are readily apparent to those familiar with the prior art. Unfortunately the new system left the traditional M16/M4 rifle equipped with a gas piston system deficient in several areas in which it previously was proficient. Examples:

1. Lack of an ability to utilize existing free float rails, and tubes. If a traditional free float tube or rail were utilized it would prevent the users from accessing the gas operating system above the barrel for cleaning purposes. Free float tubes and rails are necessary to prevent pressure from bi-pods and other accessories from pushing the hand guard, tube or rail into contact with the barrel thus compromising the weapon's accuracy potential.
2. Also recognized is the inability of the user to mount accessories which would traditionally be attached to rail interface systems. A rail interface system traditionally consists of a closed tube secured at or near the receiver of the firearm with a variety of accessory mounting rails located about the periphery of the tube. Currently available rails do not interface with a gas system and/or do not allow for access to the operating system for maintenance.
3. Other rails currently available do not facilitate the user's access to the gas piston operating system for cleaning without the total removal of the free float device. Removal of the free floating rail in its entirety to clean the operating system of the weapon will result in a loss of zero, or the ability of the weapon to direct a discharged bullet to a desired location would be compromised. In effect a military user would be prohibited from cleaning his/her weapon while in a combat environment.
4. Many currently available rail adaptor systems are difficult to install requiring an armorer or gunsmith with special tools to do the work.

Previous rail adaptor systems (RAS's) such as shown in U.S. Pat. No. 5,826,363 (Douglas Olson) have consisted of an aluminum tube which replaces the hand guards. The tube has a series of standard 1913 Picatinny slotted rails at the 3, 6, 9, and 12 o'clock positions along the longitudinal axis of the bore. These Picatinny slotted rails allow for the use and alignment of various accessories with the axis of the bore, an example being sighting equipment to increase the functional ability of the host firearm. The RAS allows the end user to customize the firearm for a mission or make employment of the rifle more ergonomic, effective and/or comfortable. A variety of RAS systems have been developed, predominantly for M16/M4 rifles and clones thereof. While not the first, U.S. Pat. No. 5,826,363 (Douglas Olson) is the first truly useful RAS system in that it is capable of mounting and carrying the modern load of combat accessories.

Examination of the prior art puts these systems into different categories. There are "conventional" designs that work with the standard hand guard retaining ring on the rifle (delta ring) and simply replace the hand guards. These systems are usually found to be two-piece designs, two semi-circular halves making up a tube. These designs transmit the weight of the accessories to the barrel of the rifle, changing the point of impact of the bullet. They also transmit external forces such as pressure from the user's hand, or force exerted by the weight of the rifle resting on a fixed support like a sandbag or bi-pod. Since these designs are mounted directly to the barrel and gas block, they transmit the heat from the barrel through the highly conductive aluminum alloy to the hand of the users.

The other general category of RAS's are one or two piece designs that use a proprietary system to clamp onto the rifle without contact with the barrel forward of the barrel nut allowing the barrel to "free float" and thus not affecting the point of impact by outside forces or the weight of the accessories mounted on it.

Once mounted, neither type of RAS is readily removable without some type of mechanical fixture and tool. None have provisions to allow easy access to parts underneath the top rail of the hand guard, leaving the user to abandon maintenance of the parts once the RAS is installed.

Mil. Std. 1913 covers specifications of the longitudinal rails affixed, molded, cast, extruded onto, or as part of the Rail Accessory System. The standard exists so that a host of manufacturers can design and manufacture accessories to easily affix to the rail and thus the rifle.

No prior art documents describe or illustrate a RAS which is readily adaptable to either a gas piston or direct gas impingement rifle design. None have made provision for a removable top rail to access the gas system for maintenance while free floating the barrel and providing clearance and ventilation for the gas system parts. There is no evidence of an RAS being conceived that could switch between rifles of one family to another with the use of simple conversion parts. No currently available RAS may be installed without a series of specialized tools.

3. Objects and Advantages

Accordingly several objects and advantages of the present invention are the proposed novel design for a new top opening, modular top rail, multi-rifle adaptable, free float Rail Adaptor System, or RAS as described herein. It was quickly recognized that the advantages of a gas piston system were negated by the fact that the user would not have the ability to use a RAS. A standard free float RAS cannot be used because gas piston systems require the user to remove, clean and maintain the parts of the gas system. All prior RAS designs were closed tubes or semi-permanent installations, not allowing clearance or access to the gas system.

The herein described RAS was conceptualized and designed to be a free float RAS which attaches to the receiver over the barrel nut and allows the user to open the top of the RAS and access the gas system parts for maintenance and service. Further, the herein described RAS allows for the use of Mil. Std. 1913 Picatinny rail mounted accessories such as back up sights, optical gun sites, lasers, vertical grips, etc. Outside forces such as the user's hand, a tensioned sling, or from resting the RAS on a stable surface such as a sand bag would not affect the firearm's point of impact. No other design is known which offers the above mentioned capabilities on a gas piston operated firearm.

(a) Modularity: The RAS system herein described has a removable top section that allows the rapid conversion of the RAS to different rifle designs which require clearance for their gas system. The user may choose a different top rail height for use with different sighting equipment or accessories. Further, different length rail sections may be added to meet the needs of the user and accommodate different barrel lengths. The RAS disclosed herein is designed to fit on a standard M4 carbine, M16 or other AR15 type rifle, well known in the prior art, and attached to the standard Mil. Spec. barrel nut which allows its use on a standard direct gas impingement system. This allows the purchaser of the herein described device an ability to acquire a single rail for use with either a direct gas impingement or a gas piston operating system. Further, the inventors of the rail have designed a variety of barrel nuts to allow the herein described novel invention to be adapted to other weapon systems.

Provisions are made to accommodate the remote switching requirements of some of the mounted accessories. Holes would be placed at various positions on the accessory adaptor rails that would allow pre-wiring of switching wires.

No other publicly known design offers this modularity between both gas piston operated rifles and direct gas impingement operated rifles.

(b) Ease of installation: To illustrate the claim of easier installation we will use the example of the M4 carbine. See FIG. 2 for an exploded diagram of the rifle mentioned. Free float RAS's already on the market require either the removal of the barrel, the front sight/gas block, the flash compensator/suppressor, delta ring, delta ring spring, delta ring retaining circle clip, hand guard retaining bracket or all of these to install the RAS. This varies with rifle model and make. None of these tasks can be performed without specific tools or a shop available to the end users. Knowledge and experience are required to complete installation of all free float RAS designs known, with the exception of the GG&G free float RAS and the TROY Industries RAS. Yet these RAS's do not readily allow access to the parts enclosed by the RAS, making them unsuitable for gas piston designs.

Examples of possible tools needed to accomplish installation of current RAS systems are as follows.

Vice
Barrel vice
A barrel nut wrench
Torque wrench
Cheater bar
Flash suppressor wrench
Drift punches
Hammer
Torch to heat and remove front sight/gas block
Headspace gauges
Barrel straightness gauge
Upper receiver vice fixture If not installed correctly by a competent armorer or gunsmith, the removal of the barrel assembly and other parts listed previously to install a conventional RAS can lead to disaster. Problems can include the gas tube being bent, barrel being bent, cross threading of the barrel nut during installation, or over-torque of the barrel nut.

The above claimed modular free float, top open RAS design only requires removal of the delta ring assembly and front hand guard bracket. This can be done with the most remedial tools as the delta ring and spring assembly could be simply cut off and disposed of as these parts are no longer necessary. The same holds true of the hand guard retaining bracket. The RAS is installed over the barrel nut with a top barrel nut clamp that is secured by 4 hex head machine screws with a standard inexpensive hexagonal wrench that can be supplied with the RAS for a nominal cost. Neither the barrel nor the gas system are disturbed and thus do not require any special tools, gauges or shop space. There is no risk to the integrity of the critical parts of the rifle system. Installation time is completed in minutes with minimal instruction, instead of hours by an experienced armorer or gunsmith. No other publicly known design offers ease of installation with the practical advantages this system offers.

(c) Ease and Cost Effective Manufacture: The herein described Modular Top Opening Free Float RAS has been designed to use cost effective aluminum alloy extrusion. All three major parts of this assembly are manufactured from the same extrusion profile. The extrusion profile can be cut to any desired length required by the end user with no change to the basic design. Having all parts by one extrusion profile ensures a tight fit and finish and cost effective manufacture that is very difficult to achieve by using separate manufacturing processes for each component. The extrusion profiles are cut and CNC machined to final specifications ensuring tight mating parts and parts compatibility. If stock extrusion profile material or extruding services are unavailable, the profiles may be manufactured from bullet aluminum by means of wire EDM cutting. No other publicly known or known patented system offers the ease or flexibility and cost effective manufacture with all mentioned practical advantages. Some of these processes are found in the prior art but there is no example found of a free float RAS where the clamping mechanism and complete tube are all made from a single extrusion. This speeds procurement to production and allows large or small orders to be filled on demand utilizing technology processes that are available by many machine shops in most US cities.

(d) Un-interrupted rail height, integrity and increased usable rail space yet retain the ability to easily remove or swing open the top half of the RAS: M4 carbines and some M16 rifles are equipped with an integral Mil. Std. 1913 rail longitudinally across the top of the upper receiver to allow mounting of a detachable carry handle, or optics and night vision equipment. This longitudinal rail across the top of the receiver is commonly referred to as a "flat top". The herein described RAS has its top rail matched in height to that of the "flat top" found on the M4 and M16 rifles. This allows a continuous Mil. Std. 1913 rail from the rear of the receiver to the front of the RAS. This continuous rails allows the user to stack optics parallel with one another down the axis of the bore.

An example of this would be stacking a standard un-magnified night vision monocular mount on the Mil. Std. 1913 rail on the rifle upper receiver, with an unmagnified red dot optical sight on the RAS. Examples of this are found in the prior art. Examples such as the Lewis Machine and Tool "Monolithic Rail Platform" and the Troy Industries MRF-C do offer a continuous top Mil. Std. 1913 rail, but neither offers the ability to easily install and remove the 12 o'clock rail which allows access to the gas system parts or allows easy installation and removal of the RAS by the end users.

(e) Ventilation of gases and dissipation of heat: provisions have been made to provide adequate clearance for the gas piston systems on the rifles mentioned above. No RAS found or related prior art allows the proper clearance for the gas piston system to protect it, ventilate it, and allow for convection cooling of the barrel assembly and gas system. The H&K 416 rifle does have a rail which clears a proprietary gas piston system. The down side is that the height of the "flat top" and the top of the rail are increased thus changing the height of the rail to bore ratio. This will negatively affect calibrated optics such as the Trijicon ACOG, well known in the prior art, and very common in military, law enforcement and civilian circles.

Still further objects and advantages will become apparent from a consideration of the ensuing description and drawings.

SUMMARY OF THE INVENTION

An improved Rail Adaptor System which interfaces with a gas piston or direct impingement operating system without modification. Provisions have been made to allow for the removal of the top rail so that maintenance may be performed on the gas operating system. The Top opening, Modular Top Rail, Multi-Rifle adaptable Free Float Rail Adaptor System (RAS) may be installed with rudimentary tools and does not require an armorer or gunsmith for installation. The barrel of a weapon system utilizing the RAS in accordance with the present invention is free floated and well ventilated to minimize the transfer of heat to the RAS itself. Mil. Std. 1913 Picatinny rails are provided at the 12, 3, 6, and 9 o'clock positions. The top rail provides a continuous length of rail by contacting the upper receiver of the M16/M4 weapons system.

BRIEF DESCRIPTION OF THE DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENTS

Figure 1:
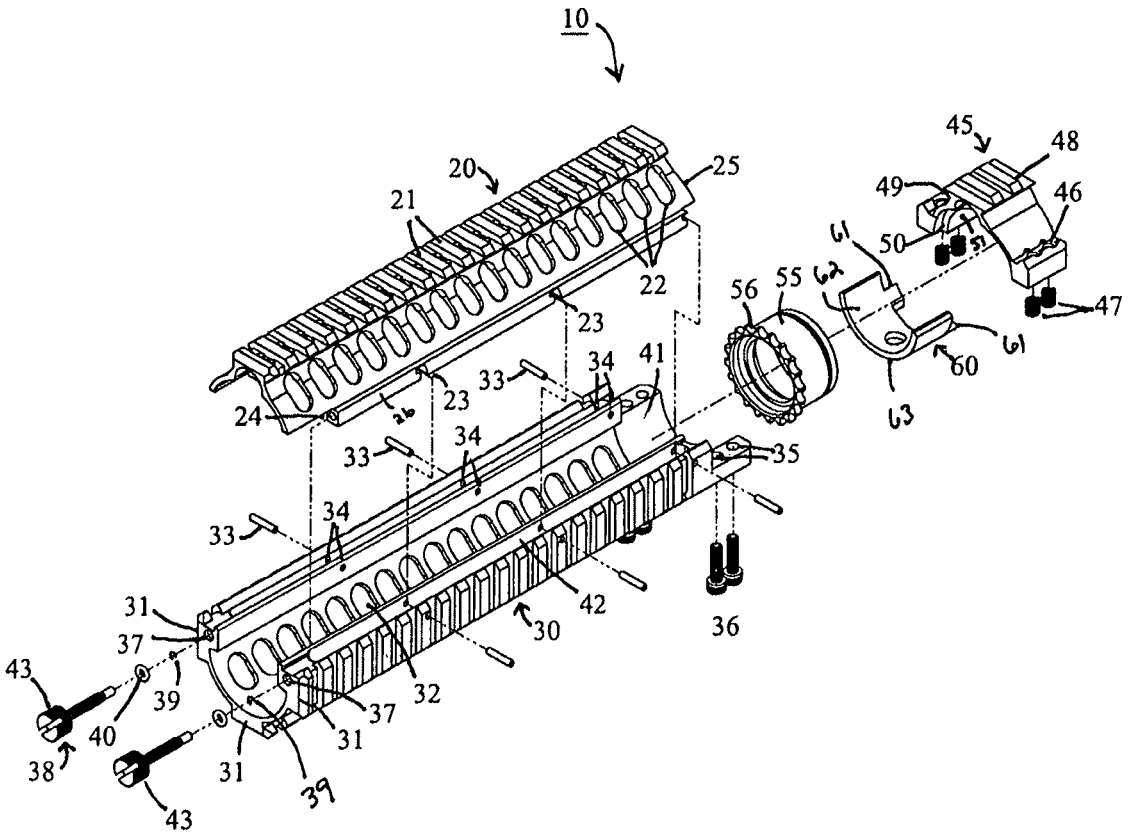
FIG. 1 is an exploded perspective view of the Top opening, Modular Top Rail, Multi-Rifle adaptable Free Float Rail Adaptor System according to the present invention.

Turning now to the drawings in which like reference characters indicate corresponding elements throughout the several views, attention is directed to FIG. 1. The Top opening, Modular Top Rail, Multi-Rifle adaptable Free Float Rail accessory system generally designated by reference numeral 10, hereinafter referred to as "RAS", has five main components which are shown in FIG. 1. The five primary components of the herein described RAS 10 are the top portion generally designated by reference numeral 20, the bottom portion generally designated by reference numeral 30, the clamp assembly generally designated by reference numeral 45, the barrel nut 55 and the anti-rotational device, generally designated by reference numeral 60.

For purposes of this description, the term forward is intended to refer to the direction toward the muzzle 101 of barrel 100, and rearward is directed toward the receiver 90. The bore of the barrel 100, common throughout the prior art, constitutes the bore line for the purposes of this disclosure.

The herein described RAS 10 has been designed to use cost effective aluminum alloy extrusions. All three major components of the RAS 10, including the top portion 20, the bottom portion 30 and the clamp assembly 45, are manufactured from the same extrusion profile. The extrusion profiles are cut and CNC machined to final specifications ensuring tight mating parts and parts compatibility.

Figure 4:
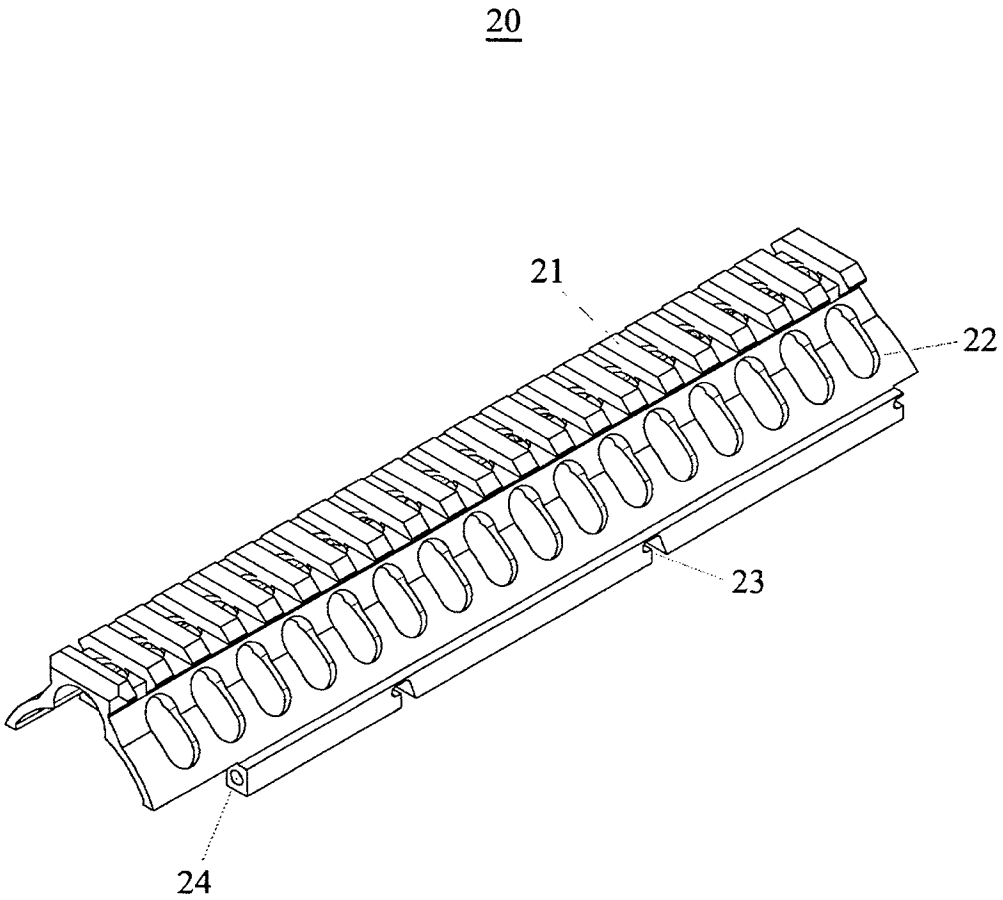
FIG. 4 is a side perspective view of the top rail assembly.

FIG. 1 shows an exploded three-dimensional view of the RAS 10. The top portion 20, shown in FIG. 4, has a Mil. Std. 1913 rail 21, and a series of perforations 22 for ventilation on each side of the Mil. Std. 1913 rail 21. Located about the edges of the top portion 20 are a series of recesses 23 which are in a J shape. At the forward end of the top portion 20 are two receptacles 24 for screws which run parallel to the bore line. There is an angled ledge 25 at the rearward end of the top portion 20. The top portion 20 forms a portion of a tubular enclosure terminating in edges 26 where a series of recesses 23 are located, which enclosure is completed by the bottom portion 30.

Figure 3:
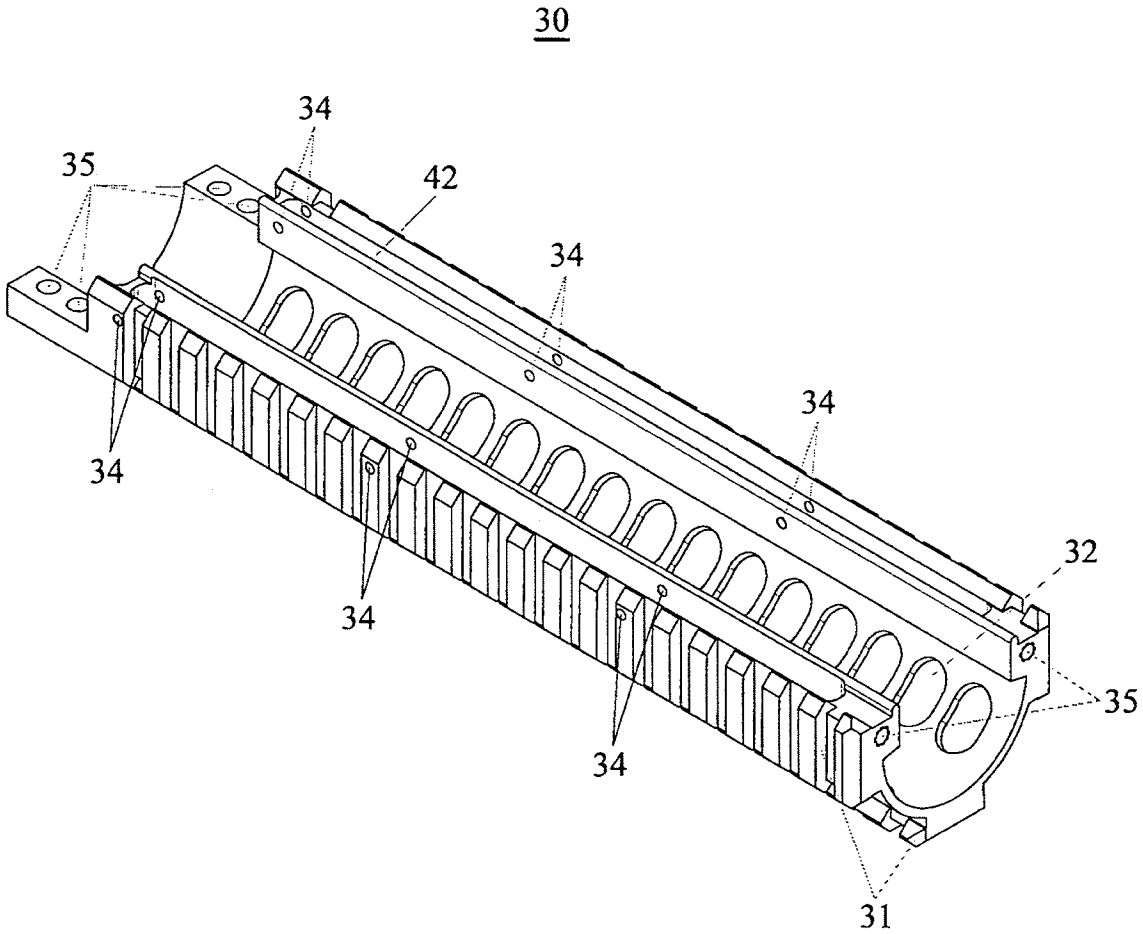
FIG. 3 is a side perspective view of the bottom rail assembly.

FIGS. 1 and 3 illustrate the bottom portion 30 which has three Mil. Std. 1913 rails 31 which run parallel to the bore line with two rows of perforations 32 placed between the Mil. Std. rails 31. Located about the edges of the bottom portion 30 are a series of hardened dowel pins 33 which are pressed into a series of openings 34 and run transverse to the longitudinal axis of the rail. Located at the rearward end of the bottom portion 30 are four receptacles 35 for threadedly securing four socket head screws 36. Located at the forward end of the bottom portion 30 are two receptacles 37 for two pusher screws generally designated by reference numeral 38. The pusher screws 38 utilize c-clips 39 and o-rings 40 as a means to retain said screws 38. The head 43 of each pusher screw 38 is textured and of sufficient size to be grasped and rotated by the end user.

Figure 5B:
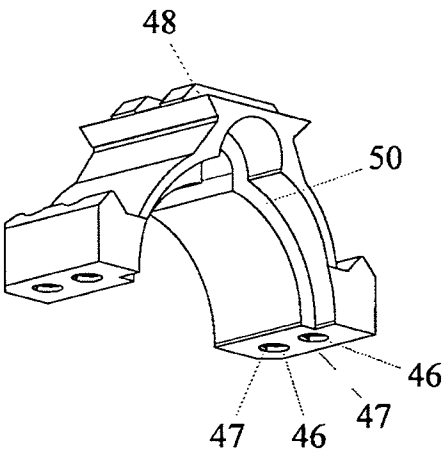
FIG. 5*b* is a side perspective view thereof.
Figure 5A:
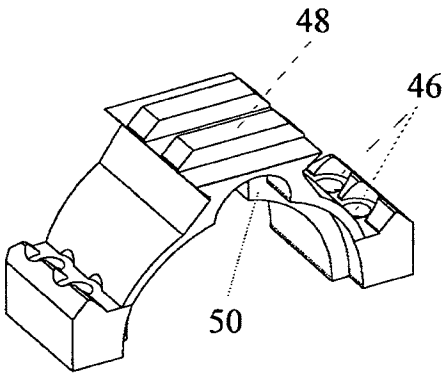
FIG. 5*a* is a perspective view of the clamp assembly for a Top opening, Modular Top Rail, Multi-Rifle adaptable Free Float Rail Adaptor System.

FIGS. 1, 5*a* and 5*b* illustrate the clamp assembly 45. The clamp assembly 45 includes four helical receptacles 46, four heli-coil inserts 47 and a single portion of mil. Std rail 48. Also present on the clamp assembly 45 is an angled face 49 on the forward area and a semi-circular groove 50 on the inside surface 51. The semi-circular groove 50 abuts the barrel nut flanges 56, when secured to the bottom portion 30 of the RAS 10, and serves to anchor the entire RAS 10 to the barrel nut 55.

Figure 6:
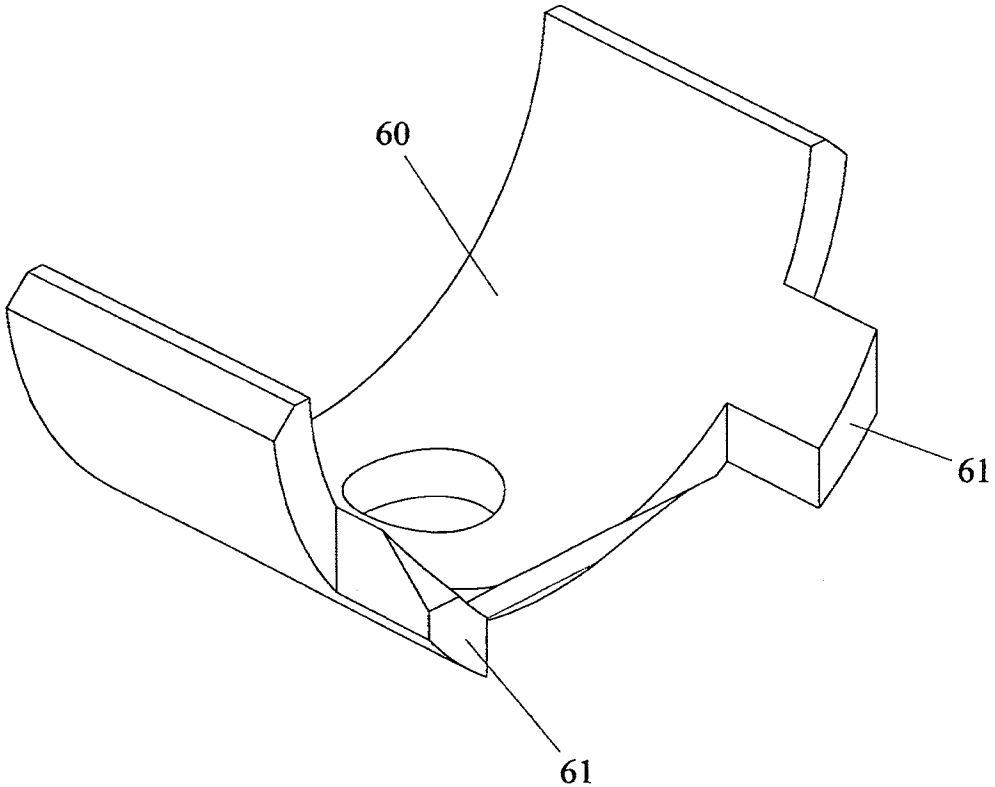
FIG. 6 is a perspective view of the anti-rotational device used with the herein disclosed invention.
Figure 7:
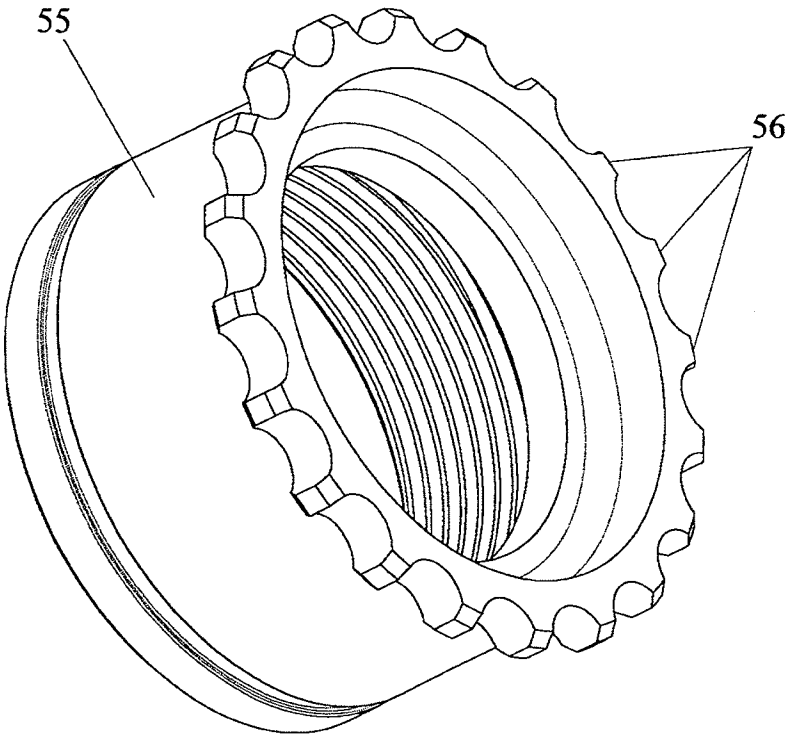
FIG. 7 is a perspective view of the preferred embodiment barrel nut for the herein described invention.

FIGS. 6 and 7 illustrate the barrel nut 55 and the anti-rotational device 60. The preferred embodiment of the barrel nut 55 has a series of outwardly directed flanges 56 which are radially placed about the forward end of the barrel nut 55. The anti-rotational device 60 has two flanges 61, a front edge 63 and a semi-circular inner surface 62 profiled to receive the barrel nut 55.

Figure 2:
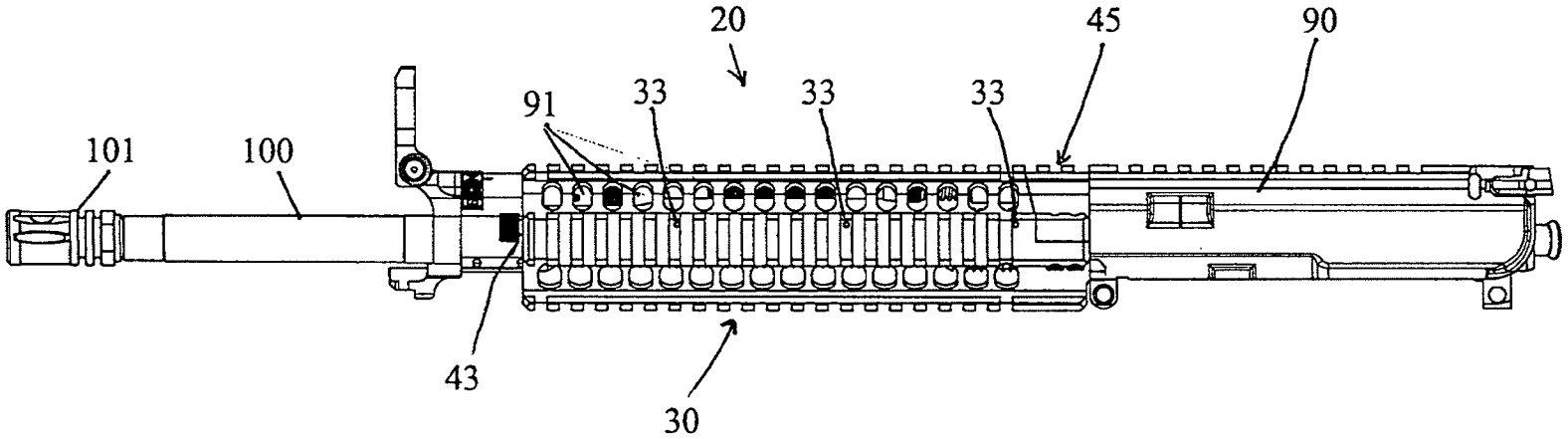
FIG. 2 is a side perspective view thereof installed on the upper receiver assembly of a firearm.

FIG. 2 illustrates the RAS 10 installed on a firearm receiver 90, with a gas piston operating system 91 as disclosed in U.S. Pat. No. 7,461,581 and a barrel 100 secured in place by the barrel nut 55. The barrel nut 55 is the point of attachment for the RAS 10. The bottom portion 30 is placed over the anti-rotational device 60 and the barrel nut 55. The flanges 56 of the barrel nut are then secured between the semi-circular groove 41 of the bottom portion 30 and the front edge 63 of the anti-rotational device. The flanges 61 of the anti-rotational device 60 are on opposite sides of the firearm receiver 90 and prevent rotational movement of the RAS 10. Clamp assembly 45 is secured about the barrel nut 55 to the rearward end of the bottom portion 30 by four socket head screws 36. Socket head screws 36 are inserted through receptacles 35 in the bottom portion 30 and threadedly secured into the clamp assembly 45 heli-coil inserts 47. With the clamp assembly 45 installed, the internal semi-circular groove 50 prevents forward and rearward movement of the RAS 10. At this point the herein described device is fully supported by the barrel nut 55 and is in effect free floating the firearm's barrel 100 illustrated in FIG. 2.

The bottom portion 30 has a void or groove 42 which runs parallel to the bore line. Six dowel pins 33 are positioned in the void or groove 42 at a transverse angle to the bore line. The top portion 20 has a series of J shaped recesses 23 that receive the dowel pins 33 pressed into openings 34 in the bottom portion 30 when the top portion 20 is translated in a rearward direction. The two pusher screws 38 are threadedly inserted into the two receptacles 37 located on the forward end of the bottom portion 30. The top portion 20 has two receptacles 24 which provided a surface for the tip ends of the pusher screws 38 to bear against. The head 43 of each pusher screw 38 is then rotated by the end user to secure the top portion 20 to the bottom portion 30. This rotational movement and the securing of the top and bottom portions can be accomplished without the use of tools. O-rings 40 are placed between the head 43 of the pusher screw 38 and the forward end of the bottom portion 30 where the o-rings 40 are compressed when the pusher screws 38 are threadedly secured into place. The o-rings 40 provide resistance and prevent the pusher screws from becoming dislodged as a result of vibrations which are incidental to the discharge of the host firearm. When so mounted, the top portion 20 is securely attached to the bottom portion 30 substantially along its entire length.

Conclusion, Ramifications, and Scope

Accordingly the present invention provides a modular rail system which is easily adapted to a firearm. The top rail is removable to facilitate the cleaning of the gas operating system. Further the herein claimed device provides a series of Mil. Std. 1913 specification rails about the periphery for the mounting of optics, laser and other devices.

While the drawings and description provided herein contain many specificities, these should not be construed as limitations on the scope of the invention, but rather as an exemplification of one preferred embodiment thereof. For example, the herein described design may be incorporated into other designs which utilize a barrel nut that protrudes from the host firearm's receiver. Another option is increasing the length of the upper and lower portions so as to protect gas systems which are longer than the one found on the preferred embodiment.

Accordingly, the scope of the invention should be determined not by the embodiments illustrated, but by the appended claims and their legal equivalents.

What is claimed:

1. A top opening, modular top rail, multi-rifle adaptable free float rail accessory system in combination with a firearm comprising:

a firearm having a gas piston operating system, a receiver, a barrel, and a barrel nut including a cylindrical portion terminating at a forwardly directed end with a radially outwardly directed flange, the barrel nut coupling the barrel to the receiver;

a free float rail accessory system having a bottom portion with a forward end and a rearward end, an inner surface of said bottom portion having a groove formed therein, perpendicular to a longitudinal axis of said bottom portion and spaced from the rearward end, the groove receiving the flange of the barrel nut to align the bottom portion with the receiver and to prevent longitudinal movement of said bottom portion;

a clamp assembly engaging a top part of the barrel nut and configured to attach to the rearward end of the bottom portion, the clamp assembly including a clamp element having a central semicircular recess receiving the cylindrical portion of the barrel nut, and a surface which is constructed to abut the radially outwardly directed flange of the barrel nut;

an anti-rotational device having an inner surface configured to receive said barrel nut, two rearwardly directed flanges on opposite sides of the firearm receiver, and a front edge, said front edge abutting the flanged end of said barrel nut when the clamp assembly is secured to the rearward end of the bottom portion, said flanges preventing rotational movement of the free float rail accessory system;

a top portion having a top section and opposing side sections extending therefrom and each terminating at an edge, the top portion and the bottom portion encircling the barrel when coupled together, said top portion being removably coupled to the bottom portion; and a manually installed component oriented to extend parallel with a longitudinal axis of said bottom portion, said component configured to removably secure and unsecure said top portion to said bottom portion when manually manipulated by a user without the use of a tool.

2. The combination as set forth in claim 1 wherein said component for securing the top portion to the bottom portion includes a plurality of screws with o-rings placed between heads of said screws and the forward end of the bottom portion to facilitate manual tightening of the screws and prevent unintentional backing out of the screws.

3. The combination as set forth in claim 1, wherein said component includes a plurality of pusher screws received within receptacles formed in said front face.

4. The combination as set forth in claim 3, further comprising o-rings placed between heads of said screws and the forward face to facilitate manual tightening of the screws and prevent unintentional backing out of the screws.

5. The combination as set forth in claim 4, wherein said pusher screws have textured heads.

6. The combination as set forth in claim 5, wherein said top portion includes receptacles for receiving tip portions of said pusher screws, said pusher screw tips thereby being seated against said top portion when tightened to secure the top portion to the bottom portion.

* * * * *